US006257310B1

(12) United States Patent
Janko

(10) Patent No.: US 6,257,310 B1
(45) Date of Patent: Jul. 10, 2001

(54) METHOD FOR MAKING HEAT SINK VACUUM

(75) Inventor: Steven P. Janko, Chesterland, OH (US)

(73) Assignee: Reliance Electric Technolgies, LLC, Thousand Oaks, CA (US)

( * ) Notice: Subject to any disclaimer, the term of this patent is extended or adjusted under 35 U.S.C. 154(b) by 0 days.

(21) Appl. No.: 09/377,259

(22) Filed: Aug. 19, 1999

(51) Int. Cl.[7] ..... B22D 19/16
(52) U.S. Cl. ..... 164/61; 164/98; 164/100
(58) Field of Search ..... 164/98, 100, 61

(56) References Cited

U.S. PATENT DOCUMENTS 4,829,642 * 5/1989 Thomas et al. ..... 164/100

* cited by examiner

*Primary Examiner*—Kuang Y. Lin
(74) *Attorney, Agent, or Firm*—Michael A. Jaskolski; A. M. Gerasimow

(57) ABSTRACT

A method for forming a heat transfer apparatus wherein a conduit construct is formed between first and second construct ends and is disposed in a mold cavity with the first and second ends extending from the cavity, air is removed from the construct, body material in molten fluid form is provided in the cavity so as to cover the construct and the molten material is permitted to solidify. In addition, the invention includes a manganese/nickel barrier material which is placed on a conduit construct prior to introducing molten material into the cavity to reduce bubbles in the sink. The invention also includes a system for maintaining heat sink temperature despite fluctuating amount of heat generated by devices mounted to or adjacent a sink wherein the system includes a temperature sensor, a controller and a regulator, the controller controlling the regulator as a function of feedback signals received from the sensor.

16 Claims, 7 Drawing Sheets

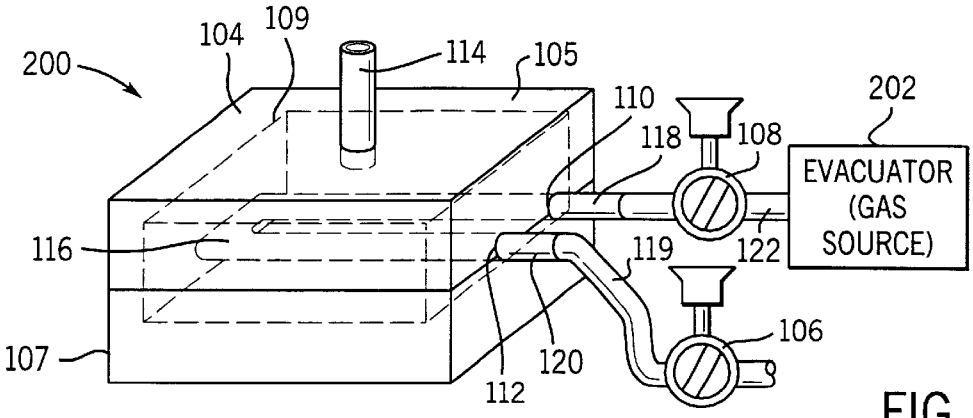
FIG. 9
FIG. 10
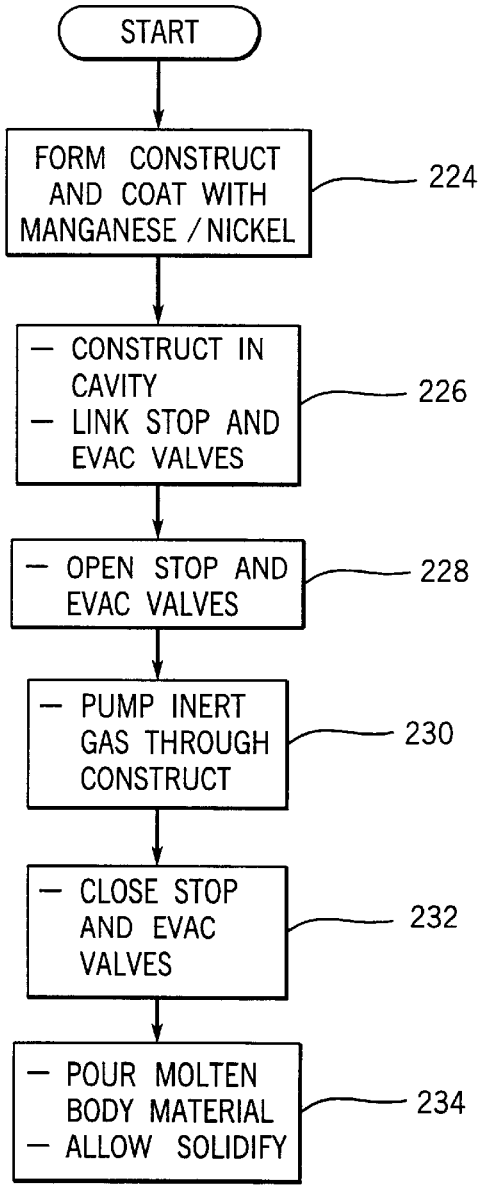

METHOD FOR MAKING HEAT SINK VACUUM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to the art of heat sinks and cold plates and finds particular application in conjunction with electronic circuitry used in industrial variable-speed electric motor drives and will be described with particular reference thereto. However, it will be appreciated that the present invention will also find application in conjunction with other electronic devices including non-industrial electronic devices and in any other application which requires a heat transfer or exchange.

A. Drive Heat

It is well known that variable speed drives of the type used to control industrial electric motors include numerous electronic components. Among the various electronic components used in typical variable-speed drives, all generate heat to a varying degree during operation. Typically, high-power switching devices such as IGBTs, diodes, SCRs, capacitors and the like are responsible for generating most of the heat in a variable-speed drive.

It is also well known that, in addition to causing damage to electronic components, if rated device temperatures are exceeded, drive heat can affect the operating characteristics of devices and therefore may affect motor control. Generally the industry has approached varying drive temperatures in two distinct ways including heat sinking and adjustment of drive control to compensate for the effects of heat on device operation.

1. Control to Compensate for Drive Heat

With respect to drive control, the operating characteristics of many drive devices and of equipment which is controlled by the devices change as a function of temperature. For example, at a first temperature one PWM switching pattern may yield a first current through a stator winding while at a second temperature the same PWM pattern yields a second current through the winding wherein the first and second currents are different. To compensate for varying device operation, elaborate control systems have been designed which sense various system characteristics and, based thereon, modify device control signals. These systems are complex to design and are relatively expensive as the parameters to be controlled are typically several times removed from the feedback signals used to control the parameters.

2. Heat Sinks to Dissipate Drive Heat

With respect to heat sinks, most sinks are air cooled but recently several liquid cooled sinks have been developed and employed to increase heat dissipating capabilities. One such liquid cooled sink is described in U.S. patent application Ser. No. 09/009,441 ("the '441 sink") which was filed on Jan. 20, 1998, is entitled "Heat Sink Apparatus and Method for Making the Same", is commonly owned with this application and is incorporated herein by reference. The '441 sink includes a conduit construct within a sink body portion wherein the construct and body portion are each formed of either aluminum or copper. To form an exemplary '441 sink, a conduit construct is configured out of copper. To form complex constructs having many bends often preformed conduit segments are brazed together. After forming the construct, the construct is coated with a barrier material (e.g. a water based graphite silica coating on an electrodeposited coating of nickel) which blocks alloying between the construct and molten aluminum and is placed within a mold. Then, molten aluminum is poured into the mold around the construct and the aluminum is allowed to cool.

Molding processes can be grouped into two general categories including one-shot molding and permanent or reusable molding processes. In the case of one-shot molding, a rigid yet easily destructible mold form is constructed so that an internal surface defines external features of an item to be formed (hereinafter "the item"). With the form constructed, the form is filled with molten material which then hardens to form the item. Often one-shot molds are formed of sand which, after the molten material hardens to form the item, can be cracked apart to remove the item from the mold. The sand is then reused to construct another mold form and the process is repeated.

In the case of a permanent mold, a rigid, typically steel mold form is constructed having an internal surface which defines external features of the item to be formed. With the form constructed the form is filled with molten material which then hardens to form the item. Perm-mold cooling can be expedited by oil which operates as a heat transfer fluid during the molding process. Unlike a one-shot form, the permanent mold form (hereinafter "the perm-mold") is reusable. Thus, after the molten material hardens, perm-mold sections are separated and the item is removed. Then, the perm-mold sections are again arranged to form another item.

Because perm-molds are reusable, despite initial additional expense, perm-molds are often more economical. This is particularly true in cases where huge numbers of identical items have to be formed rapidly. In addition to being advantageous via reuse, because perm-mold cooling can be expedited via oil, using perm-molds can increase the speed with which the molding process can occur. For example, where it might take 45 minutes to cool a sand molded item, oil can typically be used to cool a perm-mold in less than one minute. For these reasons, where possible, it is usually desirable to use perm-molds instead of one-shot molds.

It has been recognized that in any molding process there may be several sources of pressure within the mold form which can damage an item being formed and can be dangerous. In particular, in cases where a copper conduit construct is placed in a mold form and molten aluminum is provided there around, there are three primary sources of form pressure including outgassing, hydrogen draw and water vaporization.

Outgassing occurs when the hot molten aluminum heats up the copper construct and the crystalline structure of the construct material changes giving off a gas.

Hydrogen draw occurs as the copper heats up and hydrogen is effectively drawn from within the conduit through the conduit wall and forced into the aluminum via the molten aluminum heat.

Water vaporization occurs where a water based material is used to form the alloy-blocking barrier between the conduit construct and the molten aluminum. In this case, if the water in the barrier material is not completely baked off prior to placing the construct in the form and filling the form with molten aluminum, the aluminum heat causes the water to vaporize and expand further increasing the gas and hence pressure in the mold form. In addition, because a mold is typically open to ambient conditions, vaporization may occur as a result of humidity in the tube and mold cavity prior to a pour.

In each of these cases, the gases which are released into the molten aluminum cause pressure within the form. Similar problems occur when the construct is aluminum and the molten material is copper or when a stainless steel construct is used.

Gas escaping into the molten aluminum through an alloy barrier material can cause a void in the barrier material thereby allowing a path for alloying between the molten aluminum and the copper conduit construct. The alloying causes "blow through" and blocks the conduit thereby rendering the sink useless.

In addition, gas escaping into the molten aluminum expands due to the aluminum heat increasing form pressure. If form pressure exceeds a maximum level, the form and molten material therein can explode.

Moreover, even where gas escaping into the molten aluminum does not cause an explosion, the gas may become entrapped in the aluminum and cause "dross" or voids within the sink body portion which result in less efficient heat dissipation. Often, to render a sink which includes voids useable, another process has to be performed whereby voids are identified within the sink, holes are drilled into the voids and then the voids and holes are filled with molten aluminum to eliminate the voids. Obviously this addition process increases sink costs.

To minimize the amount of gas escaping into the molten material, in the '441 sink the barrier layer between the conduit construct and the molten material includes nickel which acts as a "skin" to block gas from entering the molten material. While there are several advantages of using a nickel electroplate, there are two primary advantages. First, braze alloy has a solidus temperature of 1190° F. where as the pour temperature of aluminum is approximately 1300° F. Thus, the nickel plating prevents softening of the braze alloy and transfers heat to the adjacent copper. Second, the braze alloy includes sliver which is pyrophoric with aluminum. The nickel plating prevents sliver-aluminum interaction. In order for the nickel to operate or as gas barrier the nickel laden barrier has to be at least a minimal thickness along all points along the conduit construct. While the minimal thickness can be assumed in a controlled lab environment in a less controlled manufacturing environment barrier thickness may vary, and hence, while the nickel skin may block some gas, in many cases combined crystallization outgassing and hydrogen draw cause gas to pass through the nickel barrier into the molten aluminum.

Escaping gas is particularly problematic at brazed joints between conduit sections or segments. Typical brazing compound includes a copper-silver alloy which has a substantially lower melting temperature (e.g. approximately 791° F.) than the copper conduit sections. Because of the lower melting temperature, the copper in the brazing compound recrystallizes at a lower temperature than the copper conduit and hence additional outgassing occurs at brazed joints.

There is yet another source of pressure which can occur in either one-shot or perm-mold processes which can be potentially dangerous and which is referred to as a "double-block". Imagine a conduit construct having an input end and an output end which is placed in a mold form, the form sealed around each of the input and output ends and each of the ends open. As aluminum is poured into the form, two blow throughs occur adjacent the two end so that air is trapped therebetween. As the air heats it expands and is forced through the conduit and into the form thereby increasing form pressure. Once again the form pressure may cause an explosion.

In the case of one-shot molding, sand molds are usually porous so that, within a relatively low pressure range, gas within the mold form escapes through the mold from walls. The nickel skin and escaping gas can often maintain form pressure below the maximum pressure range and therefore minimizes the possibility of causing an explosion using a sand mold form.

Nevertheless if the form pressure exceeds a maximum pressure an explosion is still possible using a sand mold. In addition, the sand mold does nothing to reduce the possibility of blow through.

In the case of a perm-mold, typical perm-molds are formed of steel and therefore are not porous. Thus, form pressure due to even a small amount of gas escaping into, and expanding in, the form can be extremely dangerous. Thus, despite the advantages associated with a reusable prem-mold, the industry has failed to develop a way to form an aluminum/copper heat sink using a perm-mold.

Thus, while perm-molding is desirable from a cost and efficiency perspective, gassing problems have prohibited perm-molding in the liquid cooled heat sink industry. In addition, gassing problems and the potential for explosion have reduced the desire to use one-shot molds in the liquid cooled heat sink industry.

Therefore, it would be advantageous have a method and an apparatus for reducing gassing problems so that molding process and more specifically perm-molding processes could be used to expedite heat sink manufacturing. In addition, it would be advantageous to have a method and an apparatus which could maintain drive temperature so that simpler drivers could be employed to control loads.

BRIEF SUMMARY OF THE INVENTION

To reduce the possibility of an explosion in both the perm-mold and one-shot molding processes, the invention includes a system and method whereby either a vacuum is formed and maintained within the conduit construct during the molding process or an inert gas is provided within the construct. In either of these cases the sources of mold pressure during the molding process are substantially reduced. For example, because there is no hydrogen in the construct hydrogen draw is essentially eliminated. In addition, even if a double block occurs, because there is no gas in the construct or the gas is inert, pressure does not build up between the double block and explosion is relatively unlikely.

In addition, the invention also includes a manganese-nickel barrier material which can be used in place of the water-based graphite and nickel (hereinafter "graphite/nickel") barrier material between the construct and molten aluminum. The manganese-nickel barrier, like the graphite/nickel barrier, is both electronically and thermally conductive and operates as a barrier to alloying between aluminum and copper. However, as well known in the metallurgical arts, manganese repels hydrogen and therefore essentially eliminates hydrogen draw. In addition, manganese is not water-based. Thus, the amount of gas escaping into the molten aluminum during a molding process is appreciably reduced.

In one embodiment both the manganese/nickel barrier and the vacuum or inert gas are employed together to minimize the likelihood of explosion. In another embodiment it is contemplated that by providing a thick enough manganese/nickel barrier or skin, the possibility of explosion, even in perm-mold molding processes, can essentially be eliminated. In yet another embodiment the vacuum or inert gas are used with a simple water based graphite/nickel barrier to reduce the possibility of explosion.

Moreover, the invention includes a liquid cooled heat sink and a control system for controlling the temperature of the sink and hence the temperature of the drive devices mounted to the sink. The system includes a temperature sensor which provides a sink surface temperature feedback signal. The signal is compared to a desired signal and, if the actual and desired signal are different at least one characteristic of the liquid provided through the sink is adjusted in a manner calculated to conform the actual temperature to the desired temperature. The characteristics which are modifiable are coolant volume per unit time and coolant temperature.

Therefore, one object of the invention is to provide a system whereby the likelihood of an explosion when forming a sink using a one-shot or a perm-mold is substantially reduced. This is accomplished via either by coating the construct with the manganese/nickel barrier, causing the vacuum within the construct or providing the inert gas within the construct or by the combination of inert gas and the manganese/nickel barrier or the combination of the vacuum and the manganese/nickel barrier.

Another object of the invention is to increase sink molding speed by enabling sink molding using per-molds.

One other object is to eliminate the need for expensive and complex drive controllers which have to compensate for drive device temperature changes. To this end, by providing a coolant control system, sink and drive device temperatures can be maintained and therefore consistent drive performance can be accomplished.

These and other objects, advantages and aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefor, to the claims herein for interpreting the scope of the invention.

BRIEF DESCRIPTION OF THE SEVERAL VIEWS OF THE DRAWINGS

FIG. 9 is a schematic diagram of a second embodiment of an evacuator system according to the present invention;

FIG. 10 is a flow chart illustrating a preferred inventive method practiced using the evacuator system of FIG. 9.

DETAILED DESCRIPTION OF THE INVENTION

Figure 1:
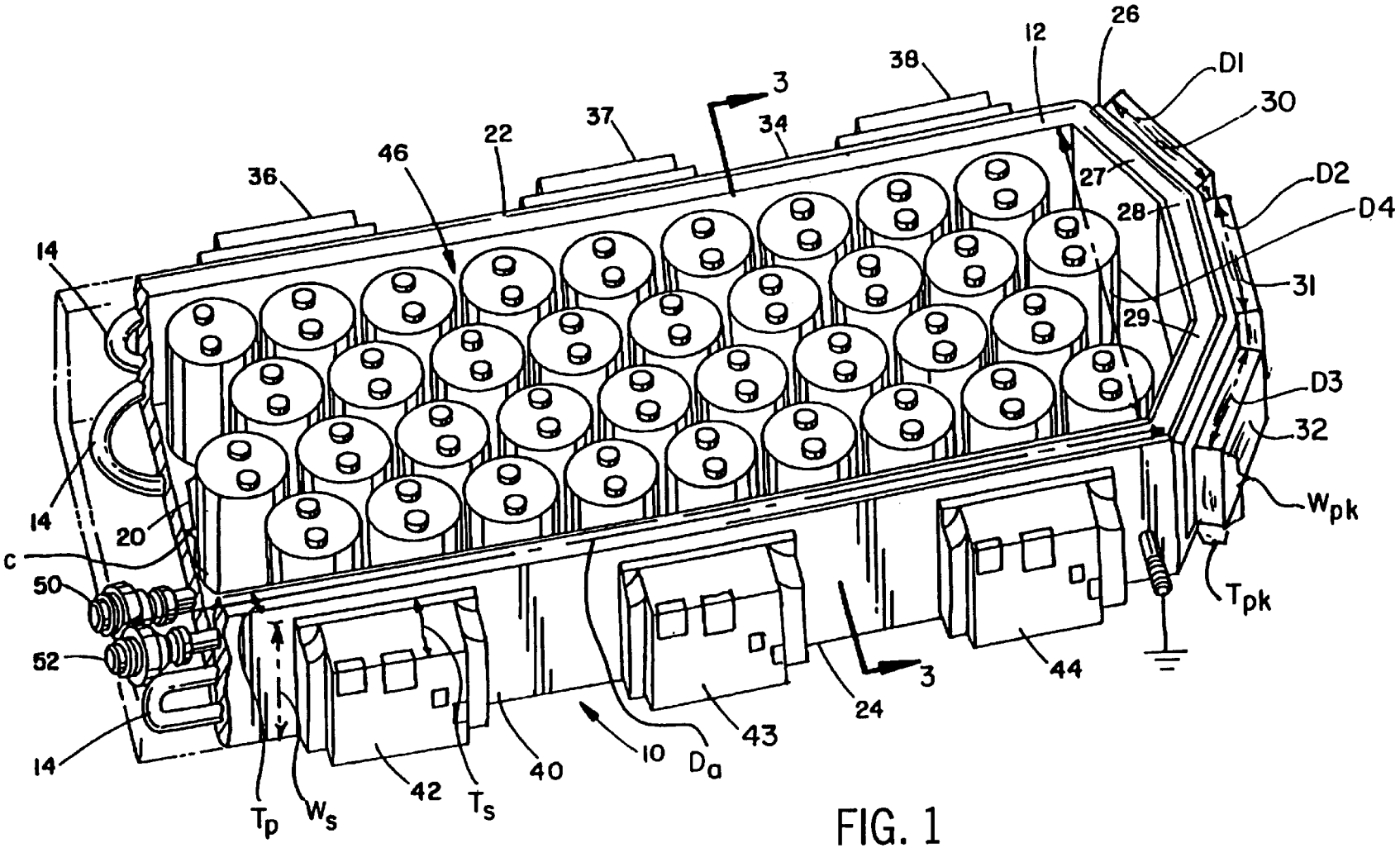
FIG. 1 is a perspective view of an inventive sink assembly showing a parallel alignment type sink with an end portion of a casting removed exposing the internal tubing.
Figure 2:
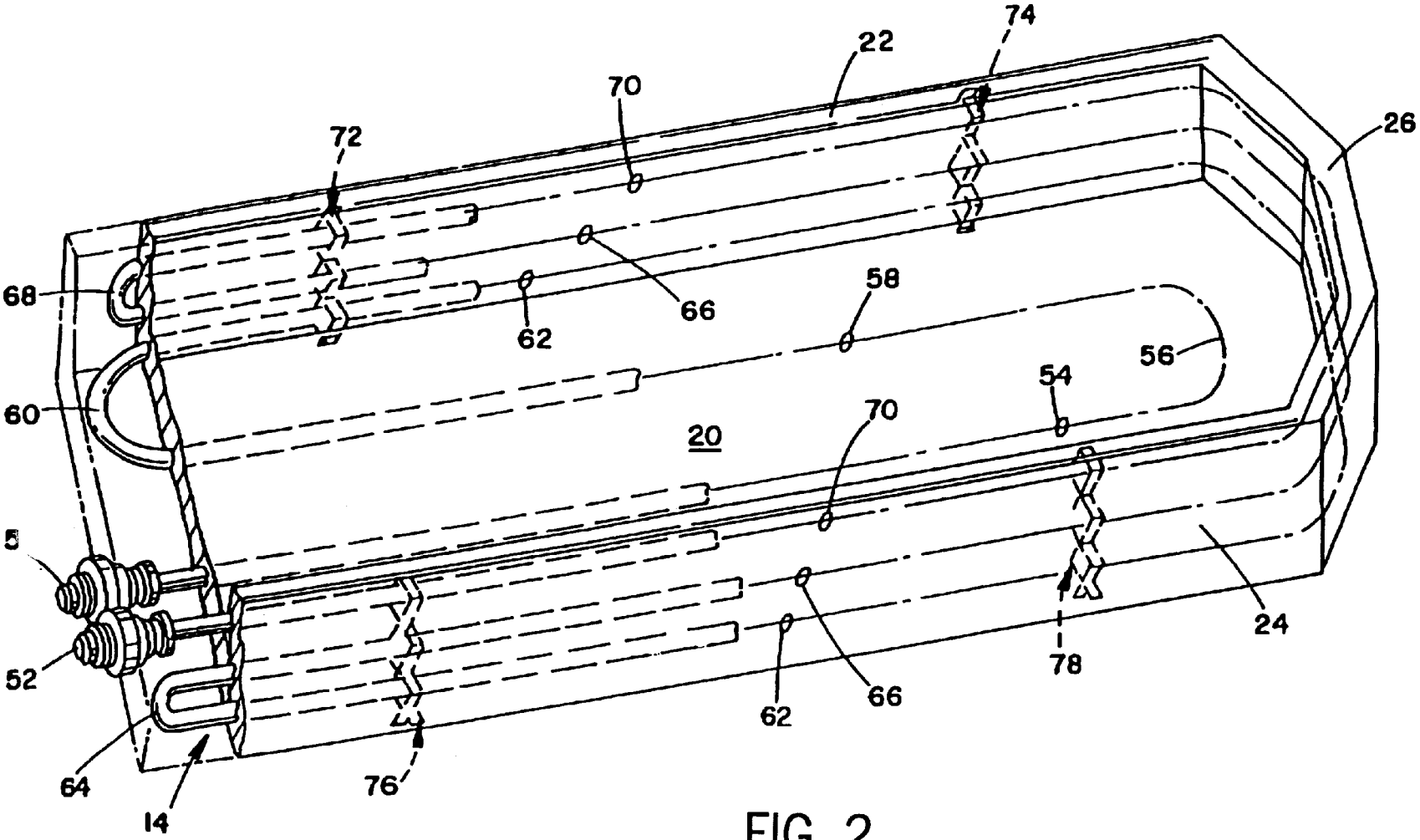
FIG. 2 is an isometric perspective view of the heat sink shown in FIG. 1 with the tubing string illustrated partially in phantom lines.
Figure 3:
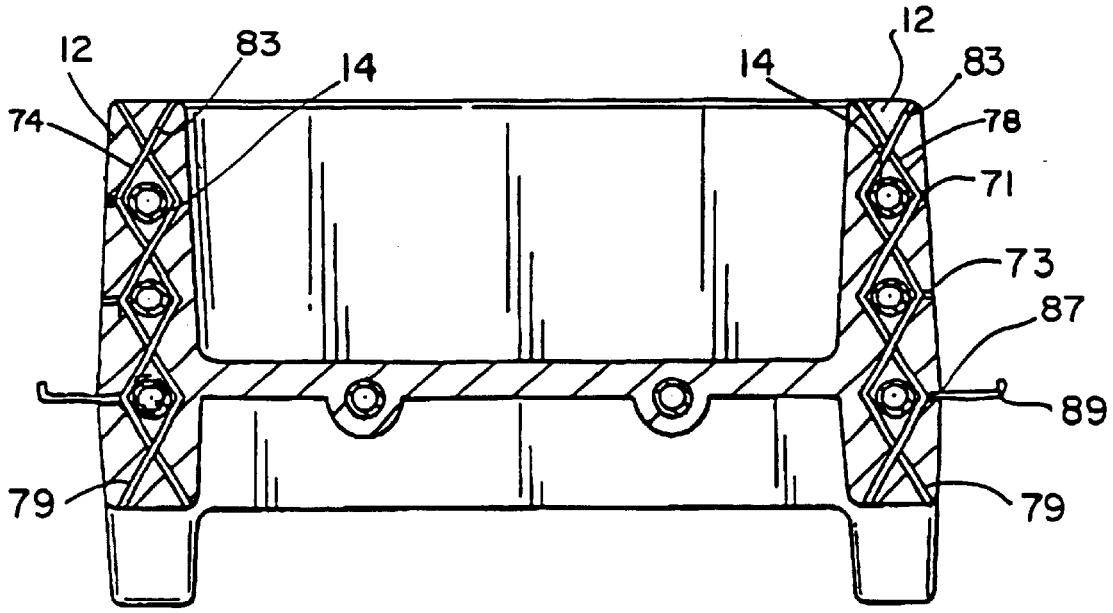
FIG. 3 is a cross-sectional view of the heat sink of FIG. 1 taken along the plane of line 3—3 of FIG. 1.

With reference to FIGS. 1–3, a heat sink assembly 10 includes a main body portion 12 and a conduit construct or tubing string 14 cast into the main body portion 12. The main body portion 12 is formed to define a substantially planar base portion 20, left and right vertical side walls 22, 24 and a vertical end wall 26. In the preferred embodiment illustrated, the vertical end wall is divided into a set of intersecting planar regions 27–29 which are adapted to receive semiconductor power package devices 30–32 thereon as illustrated. The side walls are likewise adapted to receive a set of power semiconductor switching devices. In the preferred embodiment shown, the semiconductor power package devices 30–32 and the power switching devices 36–38 and 42–44 are SCRs and IGBTs, respectively. The semiconductor power package and switching devices comprise part of a variable speed inverter motor drive including a contoured laminated bus bar formed in accordance which my co-pending application filed concurrently with this application and assigned to the game assignee entitled "Low Impedance Contoured Laminated Bus Assembly and Method for Making Same" the teachings of which are incorporated herein by reference.

The outside surface 34 of the left vertical side wall 22 is adapted to receive a set of semiconductor switching devices 36–38 as illustrated. Preferably, the semiconductor switching devices 36–38 are evenly spaced apart over the outside surface 34 of the left vertical side wall 22. This assists in an even thermal load distribution over the left vertical side wall 22. Similarly, the outside surface 40 of the right vertical side wall 24 is adapted to receive a second set of semiconductor switching devices 40–44 as illustrated. The second set of semiconductor switching devices 42–44 are also preferably evenly distributed over the outside surface 40 of the right vertical side wall 24.

Lastly, in connection with the mounting of variable-speed drive electronic components, the substantially planar base portion 20 of the heat sink assembly 10 is adapted to receive a set of high-voltage capacitors 46 evenly arranged in rows and columns as illustrated.

It is to be noted that the various electronic components disposed on the heat sink assembly 10 as described above, namely the semiconductor power package devices 31–32, the first set of semiconductor switching devices 36–38, the second set of semiconductor switching devices 42–44, and the set of high-voltage capacitors 46 comprise what is commonly referred to in the art as the "power section" of an industrial motor drive. Typically, the power section of an industrial drive generates a substantial amount of heat as compared to the other electronic subassemblies comprising an industrial variable-speed drive. In its preferred form, the power section includes capacitors 46 of the type having threaded stud members extending into the base portion 20 and thermally and electrically connected to the heat sink assembly, such as, for example, Rifa capacitors available from U.P.E. of Sweden.

With continued reference to FIGS. 1–3, the tubing string 14 includes an inlet port connector 50 and an output port 52. The tubing string 14 is preferably formed of copper and is worked into the configuration best illustrated in FIG. 2 during the manufacture of the heat sink assembly 10 as described in greater detail below. On one hand, the tubing string may be formed of a single, uninterrupted section of copper tubing. On the other hand, string 14 may be formed of a plurality of conduit construct components (e.g. joints, elbows, straight tubing sections, "T" sections, manifolds, etc.) which are brazed or welded together.

Figure 6:
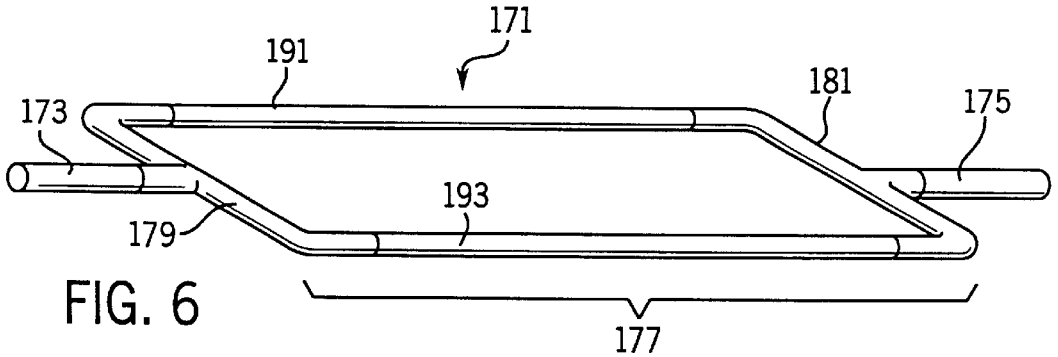
FIG. 6 is a perspective view of the tube assembly of FIG. 5.

The inlet port connector 50 of the heat sink assembly 10 is adapted to receive a coolant fluid such as a compressed refrigerant as discussed in connection with FIG. 6 below, cooled oil as discussed in connection with FIG. 7 below, and chilled water as will be discussed in connection with FIG. 8 below. After the cooling fluid enters the inlet port connector 50, it travels along a first section 54 on the tubing string defined in the substantially planar base portion 20 of the main body 12. The tubing string next forms a first bend 56 in the base portion 20 followed by a second straight section 58 also formed in the planar base portion 20. Thus, according to the preferred embodiment illustrated, the first and second sections 54, 58 and the first bend 56 are disposed in the base portion 20 of the main body 12. In that manner, the set of high voltage capacitors 46 are cooled through the base portion 20.

The tubing string 14 exits the base portion 20 and bends upward forming a first upward bend 60 as illustrated. Following the first upward bend 60, the tubing string enters the left vertical side wall 22 as shown. From there, a first U-shaped section is formed by the tubing string along the left vertical side wall, the vertical end wall 26, and the right vertical side wall. The first U-shaped section 62 next forms a second upward bend 64 which connects the first U-shaped section 62 with a second U-shaped section 66. The first and second U-shaped sections 62, 66 are disposed in the heat sink assembly in a stacked vertically spaced-apart relationship as illustrated in the Figs. The first and second U-shaped sections define spaced-apart planes which are substantially parallel with the planar base portion 20 to provide an even heat absorption distribution.

The path of the second U-shaped section 66 extends first along the right vertical side wall 24, then along the vertical end wall 26, followed by a section defined in the left vertical side wall 22. The second U-shaped section within the left vertical side wall 22 next forms a third upward bend 68 as illustrated. The third upward bend 68 is oriented substantially vertically with respect to the base portion 20 and levels off horizontally within the left vertical side wall 22 at a third plane defined by a third U-shaped section 70. The third U-shaped section 70 extends along the left vertical side wall 22 toward the vertical end wall 26 and then along the right vertical side wall as illustrated. The third U-shaped section 70 exits the heat sink assembly 10 at the output port connector 52.

During the manufacture of the heat sink assembly 10 as described in greater detail below, the tubing string 14 is supported by a set of support lattices or support members 72–78 as illustrated. Each of members 72 through 78 is essentially identical and therefore only member 78 is described here in detail. Member 78 is constructed of interlocking metallic members preferably formed of copper and suitably coated with a graphite or other suitable bonding material in a manner to be subsequently described. The metallic members are formed such that adjacent tubing sections are separated thereby. The metallic members can be configured to provide any desired spacing between adjacent tube sections. In the preferred embodiment illustrated in FIG. 3 adjacent tube sections are equispaced within each lateral wall.

Referring still to FIG. 3, in addition to maintaining the position of adjacent tube sections with respect to each other, support member 78 also maintains both the vertical and horizontal (i.e. lateral) positions of tube 14 within body portion 12. Referring also to FIG. 12, support member 78 and associated tubing 14 are illustrated inside a drag 77 of a sink mold. To maintain vertical position of tube 14 within body portion 12, when member 78 is positioned within drag 77, lower distal ends 79 of member 78 extend downward and contact an adjacent internal surface 81 of drag 77. Similarly, upper distal ends 83 of member 78 extend upward and contact an adjacent surface of a mold cope (i.e. the upper mold half (not illustrated).

To maintain horizontal position of tube 14 within body portion 12, member 74 also includes lateral extensions 71, 73 and 87. Each of extensions 71 and 73 is sized such that, as illustrated in FIG. 12, when support member 78 is positioned within drag 77, distal ends thereof contact an adjacent internal drag surface 85, thereby limiting lateral tube movement. In addition, member 87 extends laterally along a break line between drag 77 and an associated cope (not illustrated), past surface 85 and includes a distal finger member or hook 89. A recess 91 is provided in drag 77 for receiving lateral extension or finger member 89. With finger member 89 received within recess 91, when the cope is secured to drag 77 prior to and during a mold forming procedure as described in detail below, member 87 further limits lateral support member 78 movement and hence maintains lateral tube position.

The support members 72–78 hold the tubing string sections in place, in the vertically spaced-apart relationship as illustrated in a mold while the molten material is poured during the casting process. Thus, in the preferred embodiment illustrated, the support members 72–78 become frozen in the vertical side walls 22, 24 during the heat sink fabrication process.

Also, in accordance with the present invention, the support members are adapted to hold various stud members or other mechanical connection devices in place during the molding process. Additional support members can be provided at various selected locations to hold the stud or attachment members in place. In that way, the studs and connection devices become frozen in the casting at predetermined positions and orientations for convenient attachment of drive hardware, electronic devices, or the like thereto.

Figure 4:
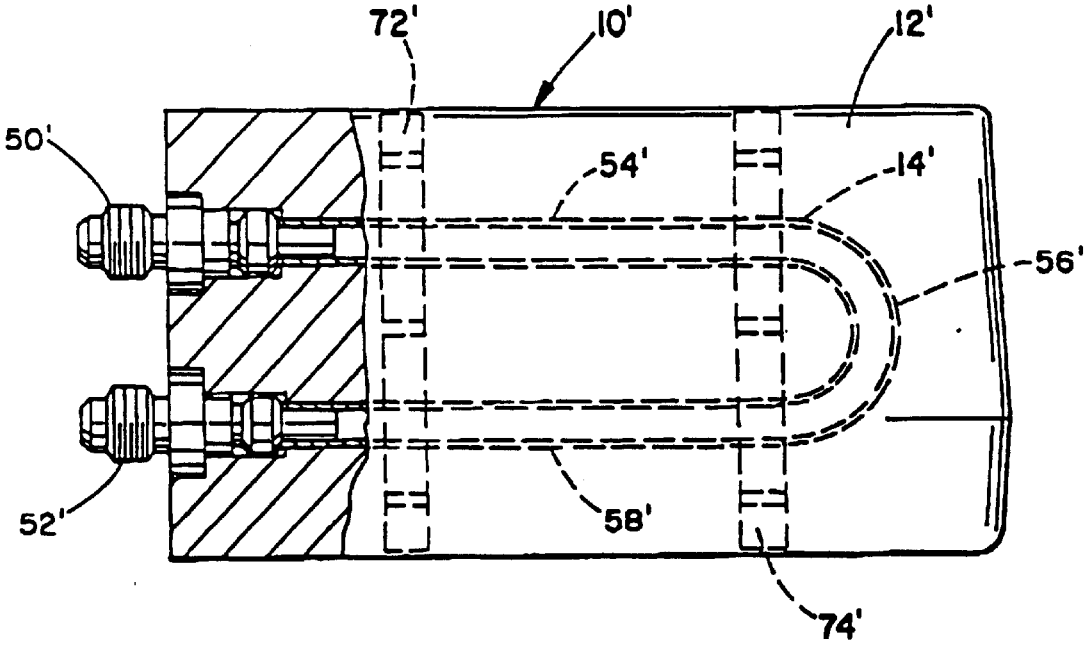
FIG. 4 is a perspective view of an alternate configuration of the heat sink of the present invention.

With reference next to FIG. 4, an alternate configuration of the heat sink of the present invention is illustrated. As shown there, a heat sink assembly 10' includes a main body portion 12', preferably formed of copper or aluminum, and a tubing string 14' preferably formed of copper or aluminum. The tubing string 14' enters the main body portion 12' at a inlet port connector 50' and extends into the main body portion 12' along a first section 54'. A first bend 56' returns the tubing string direction back towards the output port 52' along a second section 58' formed by the tubing string 14 within the main body portion 12. The second section 58' exits the main body portion 12' at an output port 52'. Similar to the embodiment described above in connection with FIGS. 1–3, the alternate configuration illustrated in FIG. 4 includes a set of support members 72', 74'. The support members function the same as described above. FIG. 4 illustrates that the present invention is not limited to the particular embodiment illustrated in FIG. 1 but is adaptable for use in connection with any heat generating devices or apparatus. As shown in FIG. 4, the present invention can be used to provide a substantially planar, rectangularly shaped heat sink apparatus for use in any heat transfer application. The difference in shape and arrangement illustrated between FIGS. 1 and 4 demonstrates that the present invention is adapted to provide a combined heat sink and housing system for virtually any application.

Figure 5:
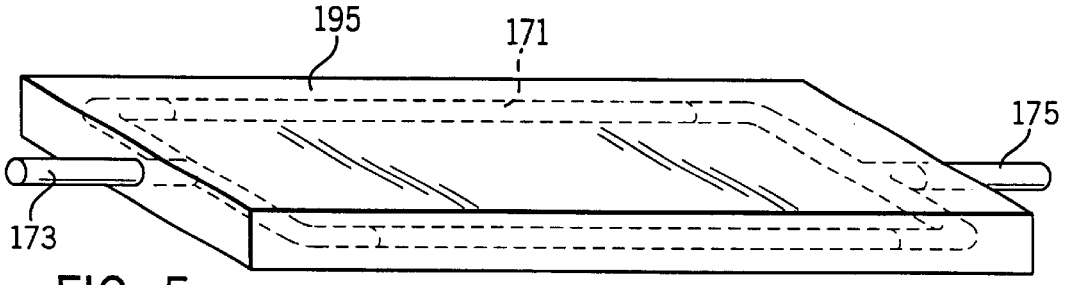
FIG. 5 is a perspective view of a sink assembly according to yet another aspect of the invention.

Referring now to FIG. 5, yet a third embodiment of the invention is illustrated. In this embodiment, instead of providing a serpentine tube path, throughout a sink body portion, a spreading type tube path having more than a single route through the body portion is provided. To this end, referring also to FIG. 6, a tube assembly 171 for guiding coolant includes a first conduit or inlet port 173 at a first end, a second conduit or outlet port 175 at a second end opposite the first end and a spreader 177 which is linked between the first and second conduits 173 and 175, respectively, and forms two passageways therebetween. Spreader 177 includes a first manifold 179 which is linked to first conduit 173 and splits into two different paths, a second manifold 181 which is linked to second conduit 175 and also splits into first and second paths and first and second ducts 191 and 193 which traverse the distances between the first paths and the second paths, respectively. A similar sink design including two manifolds is illustrated in FIG. 23 and is described in more detail below.

The conduits, manifolds and ducts are secured together via brazing, typically using a copper-zinc or copper-silver compound as well known in the plumbing art. A barrier material (e.g. manganese/nickel electroplating) is provided on the external surface of the conduit construct. Next, the body portion 195 (see FIG. 17) is formed around assembly 171 such that the ends of conduits 173 and 175 extend from opposite sides of body 195 and so that all brazed joints are encased within body 195.

Brazing enables pre-fabricated conduit construct components (e.g. elbows, joints, "T" members, straight tubing sections, etc.) To be linked together in essentially any conceivable form to configure one serpentine cooling path or a manifolded multi-path design for cooling liquid. Using prefabricated conduit components tight radii are easily achievable or, in the case of some configurations including a manifold, are completely eliminated. Assuming a thick enough barrier material layer, using a barrier material which blocks outgassing enables use of copper conduit and conventional brazing compounds without substantial risk of explosion.

Figure 7:
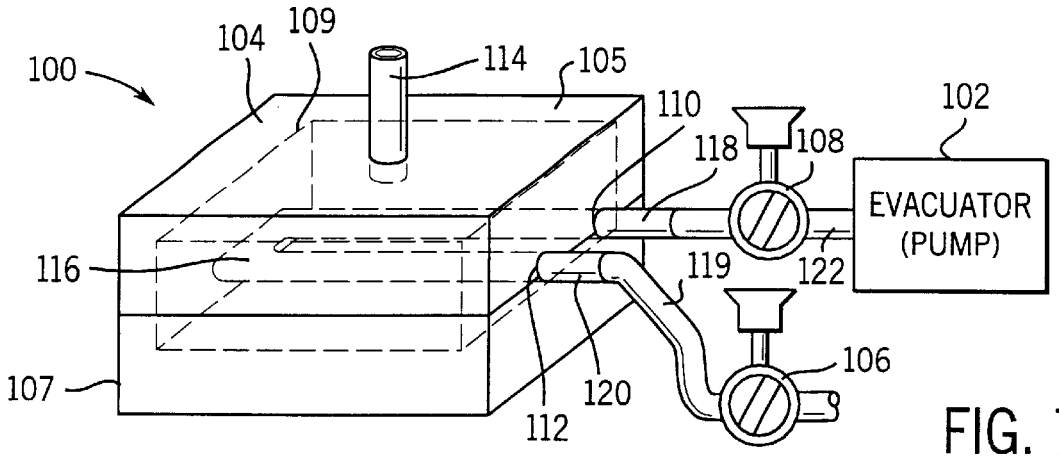
FIG. 7 is a schematic diagram of a first embodiment of an evacuator system according to the present invention.

Referring now to FIG. 7, a first apparatus 100 for manufacturing a heat sink according to the present invention is illustrated. Apparatus 100 includes an evacuator 102, a mold 104, a stop valve 106 and at least one additional valve 108. Mold 104 includes a cope 105 and a drag 107 which come together to form a mold cavity 109. Cavity 109 defines the external surface of a sink to be formed and in the example is shown in phantom as being rectilinear. Mold 104 also forms a conduit construct inlet 110, construct outlet 112 and a molten material inlet 114, each of which open into the cavity 109.

A conduit construct 116 is shown (in phantom) formed and positioned within cavity 109 with its ends 118, 120, linked to inlet 110 and outlet 112. Cope 105 and drag 107 are hermetically sealed about the ends 118 and 120 so that molten material cannot escape from cavity 109 therethrough. Preferably, construct 116 is formed of copper and is then coated with a barrier material which minimizes outgassing and blocks alloying between the copper construct and the molten aluminum. To this end the preferred barrier material is a manganese nickel compound wherein the manganese is between 1 and 10% of the compound but most preferably is approximately 4%. The nickel acts as the barrier to alloying while the manganese operates to minimize outgassing.

Stop valve 106 is mounted to end 120 via a tube 119 and valve 108 is mounted to end 118. A tube 122 links valve 108 to evacuator 102. I this example, evacuator 102 is a pump which is capable of forming a vacuum within construct 116. Although not illustrated a molten aluminum source would be linked to inlet 114 to provide molten aluminum to cavity 109.

Figure 8:
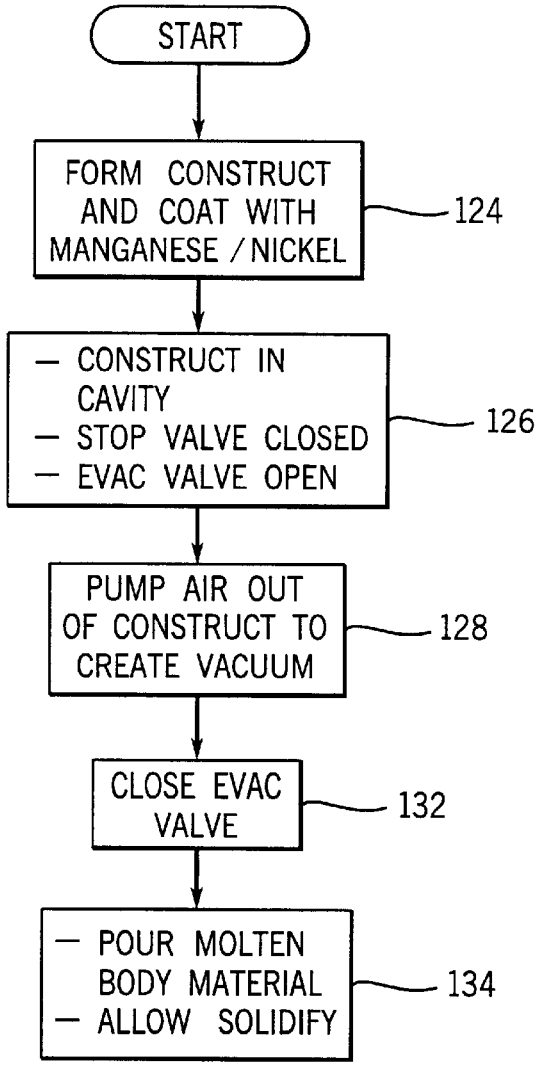
FIG. 8 is a flow chart illustrating a preferred inventive method practiced using the evacuator system of FIG. 7.
Figure 11:
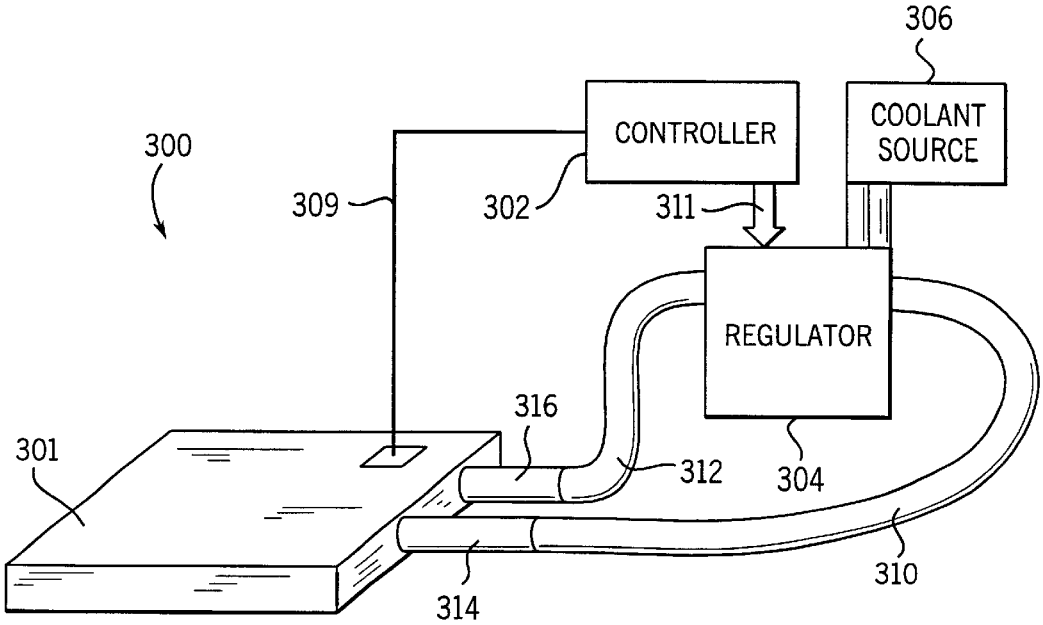
FIG. 11 is a schematic diagram of an inventive control system for regulating and maintaining sink heat.

Referring also to FIG. 8, a preferred method of using system 100 (see FIG. 7) is illustrated. To this end, at block 124 construct 116 is formed and is coated with the manganese/nickel barrier layer. At block 126 construct 116 is disposed in or placed within cavity 109 so that ends 118 and 120 are hermetically sealed within inlet 110 and outlet 112, respectively. Also, at block 126 stop valve 106 is secured to end 112 and is closed and valve 108 is secured to end 110. At block 128 evacuator 102 is linked via tube 122 to valve 108.

With stop valve 106 blocking end 120 and valve 108 open, at block 128 pump 102 is turned on causing a vacuum within construct 116 which evacuates all of the air from within conduit construct 116. At block 132 valve 108 is closed to maintain the vacuum within construct 116 at which point pump 102 is turned off.

Next, at block 134 molten aluminum is provided in fluid form through inlet 114 and into the cavity 109 until cavity 109 is completely filled. After cavity 109 is filled, the molten aluminum is permitted to solidify. In the case of a perm-mold, a cooling oil system may be used to expedite the cooling and solidifying process thereby increasing system turn-around.

Referring now to FIG. 9, a second apparatus 200 for manufacturing a heat sink according to the present invention is illustrated. Apparatus 200 is essentially identical to apparatus 100 (see FIG. 8) with one exception and therefore, with respect to identical components, those components are numbered the same in each of FIGS. 8 and 9 and are not again explained here in detail. The distinction between embodiments 100 and 200 is that, instead of being a pump, the evacuator 202 in embodiment 200 is an inert gas source for replacing the air within construct 216 with an inert gas. Preferably the inert gas is nitrogen.

Referring also to FIG. 10, a preferred method of using system 200 (see FIG. 8) is illustrated. To this end, at block 224 construct 116 is formed and is coated with the manganese/nickel barrier layer. At block 226 construct 116 is disposed in or placed within cavity 109 so that ends 118 and 120 are hermetically sealed within inlet 110 and outlet 112, respectively. Also, at block 226 valve 106 is secured to end 112 and valve 108 to end 110. At block 228 evacuator 202 is linked via tube 122 to valve 108.

At block 228 valves 106 and 108 are both opened. At block 230 evacuator 202 is turned on providing inert gas (e.g., nitrogen) to construct 116 and forcing air out valve 106. At block 232 valves 108 and 106 are closed to maintain the inert gas within construct 116 at which point evacuator 202 is turned off. Evacuator 202 effectively removes the air from construct 116 by filling construct 116 with inert gas to flush the air out.

Next, at block 234 molten aluminum is provided fluid form through inlet 118 and into the cavity 109 until cavity 109 is completely filled. After cavity 109 is filled, the molten aluminum is permitted to solidify. In the case of a perm-mold, a cooling oil system may be used to expedite the cooling and solidifying process thereby increasing system turn-around.

It should be appreciated that with either of the inventive apparatuses and/or methods described above the possibility of an explosion from expanding gas trapped within any type of mold is substantially reduced. As indicated above, the magnesium barrier layer reduces hydrogen draw and minimizes or eliminates condensation on the conduit construct and therefore reduces the quantum of gas within the mold cavity. In addition, the nickel in the barrier blocks alloying between the aluminum and copper and therefore reduces the likelihood of blow through. Moreover, by removing all hydrogen from within the construct via either an inert gas evacuator or a vacuum evacuator, the possibility of an explosion due to a double block is eliminated.

Referring now to FIG. 10, one embodiment of an inventive system 300 for maintaining a sink 301 temperature despite fluctuating amounts of heat generated by devices connected thereto or in the vicinity thereof is illustrated. System 300 includes a controller 302, a regulator 304, a coolant source 306 and a temperature sensor 308.

Regulator 304 includes an inlet tube 310 and an outlet tube 312 which are linked to a sink outlet 314 and a sink inlet 316, respectively. Regulator 304 must be equipped to, in some manner, quickly modify the cooling capability of the coolant provided to sink 301 such that the temperature of sink 301 can be maintained essentially constant. To this end, for instance, regulator 304 may be able to modify coolant flow rate through sink 301. For example, if sink temperature increases slightly, regulator increases coolant flow. In the alternative, regulator 304 may be able to change the temperature of coolant provided to sink 301. In this case, where a temperature increase occurs, regulator 304 decreases the coolant temperature to adjust the sink temperature and thereby to adjust the temperatures of the devices mounted to sink 301.

To adjust coolant temperature regulator 304 is linked to a coolant source 306. To increase coolant temperature, regulator 304 reduces the amount of coolant exchanged with source 306 and to decrease coolant temperature regulator increases the amount of coolant exchanged with source 306.

In the illustrated example sensor 308 is facially mounted to a surface of sink 301. Nevertheless, other sensor configurations are contemplated including a sensor which is embedded within sink 301, a sensor which is adjacent (i.e. not touching) sink 301 or a network of sensors for sensing temperatures at different points on or within or adjacent sink 301.

Controller 302 includes a microprocessor (not illustrated) for controlling regulator 304 based on sink temperature. To this end, controller 302 is linked to sensor 308 via a feedback bus 309 and is linked to regulator via a control bus 311. Controller 302 runs a software program which includes a plurality of rules which determine how regulator 304 should be controlled as a function of the temperature signal generated by sensor 308. While complex rules could be employed, in most cases simple rules which linearly change some aspect of the coolant provided by regulator 304 based on temperature change will suffice.

In addition to a sink temperature controller, the invention also includes a method of controlling a sink temperature wherein a liquid cooled heat sink including a conduit construct which traverses the distance between first and second ends and a sink body linked to the construct and juxtaposed adjacent the heat generating system such that system heat is absorbed by the body is provided. A coolant is provided to the construct to dissipate construct and body heat. The sink temperature is sensed and a temperature feedback signal is provided and at least one characteristic of the coolant is modified to control the temperature of the system.

The invention has been described with reference to the preferred embodiments. Obviously, modifications and alternations will occur to others upon reading and understanding the preceding detailed description. It is intended that the invention be construed as including all such modifications and alterations insofar as they come within the scope of appended claims or the equivalents thereof. For example, while most of the embodiments described above are described as being formed using a copper conduit construct and body members for a body portion formed of aluminum, other metal combinations are contemplated including an aluminum conduit construct embedded in copper, a copper conduit construct embedded in copper, an aluminum conduit construct embedded in aluminum, a stainless steel conduit construct embedded in aluminum, any one of the embodiments above including either a copper alloy (e.g. hastelloy which is a copper-nickel compound), or an aluminum alloy instead of copper or aluminum, respectively, and so.

Furthermore, while conduit constructs in the illustrated embodiments form single serpentine paths, clearly, multipath conduit constructs which include one or more manifolds or "T" sections are contemplated.

Moreover, while the methods and apparatuses described above incorporate both the manganese/nickel barrier layer and To apprise the public of the scope of this invention, we make the following claims:

What is claimed is:

1. A method for forming a heat transfer apparatus from first and second materials which are characterized by first and second melting temperatures, respectively, and, wherein, the first and second materials alloy at a lower temperature than each of the first and second temperatures, the method comprising the steps of:

forming a conduit construct including a first portion from the first material, the first portion forming a passageway which traverses the distance between first and second construct ends;

disposing at least the construct first portion in a mold cavity; evacuating substantially all air from the construct;

introducing the second material in molten fluid form into the cavity so as to cover the construct; and permitting the molten material to solidify.

2. The method of claim 1 wherein the step of removing includes forming a vacuum in the construct.

3. The method of claim 2 wherein the step of forming a vacuum includes the steps of blocking the first end and forming a suction at the second end.

4. The method of claim 1 wherein the step of removing includes filling the construct with an inert gas.

5. The method of claim 4 wherein the step of filling includes blocking each of the first and second ends.

6. The method of claim 5 wherein the inert gas is nitrogen.

7. The method of claim 1 further including the step of, prior to introducing, eliminating all moisture within the construct.

8. The method of claim 1 wherein aluminum and copper are sink materials and wherein at least one of the first or second materials is a sink material.

9. The method of claim 8 wherein the first material is copper.

10. The method of claim 1 further including the step of, prior to introducing, coating the first portion with a binder material which operates as a barrier to alloying between the first and second materials.

11. The method of claim 1 wherein the mold is a permanent mold.

12. An apparatus for forming a heat sink from first and second materials which are characterized by first and second melting temperatures, respectively, the first and second materials alloying at a lower temperature than each of the first and second temperatures, the apparatus comprising:

a mold defining the external surface of the sink and said sink including a conduit having an inlet and an outlet; and an evacuator linked to the inlet and outlet for removing substantially all air from within the space between the inlet and outlet;

wherein, to form a heat sink, a first end and a second end of a conduit construct which is formed of the first material are linked to the inlet and outlet, respectively, so that the space defined by the construct is between the inlet and the outlet, after the evacuator is used to remove air from within the construct, the second material is introduced in molten form into the mold and is permitted to solidify.

13. The apparatus of claim 12 wherein the evacuator is a vacuum device and the vacuum device is used to form a vacuum in the construct prior to introducing the molten material.

14. The apparatus of claim 13 wherein the vacuum device includes a suction apparatus and a block, the block used to block the inlet and the suction apparatus linked to the outlet to form the vacuum.

15. The apparatus of claim 12 wherein the evacuator includes an inert gas source and the air is removed by filling the construct with inert gas.

16. The apparatus of claim 12 wherein the mold is a permanent mold.

* * * * *